United States Patent [19]

Zumwalt

[11] 4,097,105

[45] Jun. 27, 1978

[54] HARNESS FOR PLUG AND SOCKET

[76] Inventor: Floyd A. Zumwalt, Rte. 2 Box 140G, McMinnville, Oreg. 97128

[21] Appl. No.: 765,863

[22] Filed: Feb. 4, 1977

[51] Int. Cl.[2] ..... H01R 13/54

[52] U.S. Cl. ..... 339/75 P; 339/103 R

[58] Field of Search ..... 339/39, 42, 82, 89, 339/87, 91 R, 103 R, 105, 75 P

[56] References Cited

U.S. PATENT DOCUMENTS

| | | | |
|---|---|---|---|
| 2,725,543 | 11/1955 | Tanner | 339/91 R X |
| 2,753,536 | 7/1956 | Tjader | 339/75 P |
| 3,613,046 | 10/1971 | Kirk | 339/75 P |

FOREIGN PATENT DOCUMENTS

| | | | |
|---|---|---|---|
| 1,465,325 | 4/1969 | Germany | 339/75 P |

*Primary Examiner*—Roy Lake
*Assistant Examiner*—E. F. Desmond
*Attorney, Agent, or Firm*—James D. Givnan, Jr.

[57] ABSTRACT

A harness for installation on a coupled plug and socket with the harness including a primary ring-like member from which a pair of elongate connectors extend in perpendicular fashion. A second ring-like member is adjustably coupled to the elongate connectors to permit harness installation on a variety of plug-socket combinations. The ring-like members are also adjustable for like purposes. The harness may release the plug and socket under extraordinary forces.

2 Claims, 3 Drawing Figures

HARNESS FOR PLUG AND SOCKET

BACKGROUND OF THE INVENTION

The present invention concerns a harness for maintaining an electric plug and socket combination in coupled relationship.

Various arrangements have been proposed for attachment to a coupled plug and socket for the purpose of preventing accidental separation. A drawback to most such arrangements is their complexity resulting in a high cost of manufacture, awkward installation on the plug and socket and susceptibility to accidental detachment from the joined plug and socket. An additional drawback to known plug and socket harnesses is their restricted adaptability to a limited range of plug and socket combinations.

A common problem experienced by construction workers, and particularly those using electrical power tools served by long extension cords, is the inadvertent uncoupling of plug and socket members. Such uncoupling most usually results from tensioning of the cord while a cord segment is temporarily held by an obstruction of one sort or another. The workman, in an attempt to release the cord, pulls same resulting in uncoupling of the plug and socket whereupon work time is subsequently lost in recoupling same. Where a workman, such as a carpenter, is using a power tool in a multi-floor structure, the uncoupling can be particularly troublesome.

SUMMARY OF THE PRESENT INVENTION

The present harness includes ring-shaped components for disposition adjacent opposite ends of the combined plug and socket with one of said ring members having a pair of integral elongate connectors. Interengaging means on said connectors and the other ring-shaped member enables joining of the two ring-shaped members in various spaced apart relationships. This feature, along with the connectors being of a highly flexible nature, permits the present harness to be readily applied to a wide variety of plug and socket combinations having wide variances in both length and cross-sectional dimensions. The connectors are configured at their ends to avoid entanglement with obstructions which might jeopardize harness integrity. Further, the elongate connectors may inclue non-continuous segments for the purpose of providing a pre-determined release point to permit harness release in the event of an emergency such as the grounding of a power tool through its operator.

Important objects of the present harness include: the provision of a harness highly adaptable to a wide variety of plug and socket combinations that may be encountered in the field; the provision of a harness lending itself to low-cost manufacturing methods to provide a reliable harness of low cost to the user; the provision of an adjustable harness having but two components thereby greatly reducing the possibility of loss of a component; the provision of a harness having a compact profile not susceptible to snagging on the various types of obstructions encountered; the provision of a harness permitting intentional release of the plug and socket upon exertion of extraordinary force on the tool associated power cord.

These and other objectives of the present invention will become subsequently apparent upon an understanding of the following description of the harness.

DETAILED DESCRIPTION OF THE PREFERRED EMBODIMENTS

Figure 1:
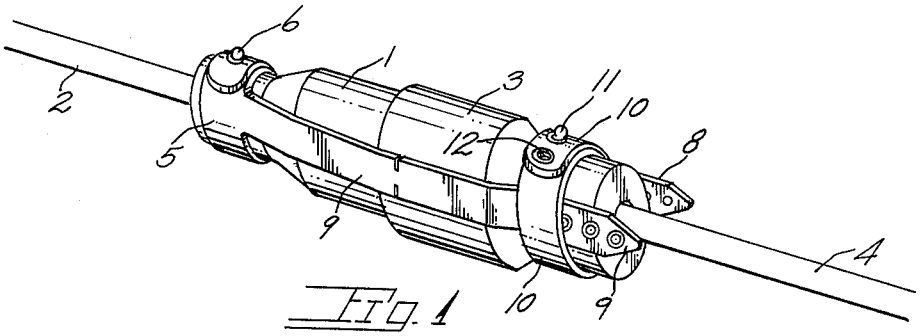
FIG. 1 is a perspective view of the present harness in place on a plug and socket.
Figure 2:
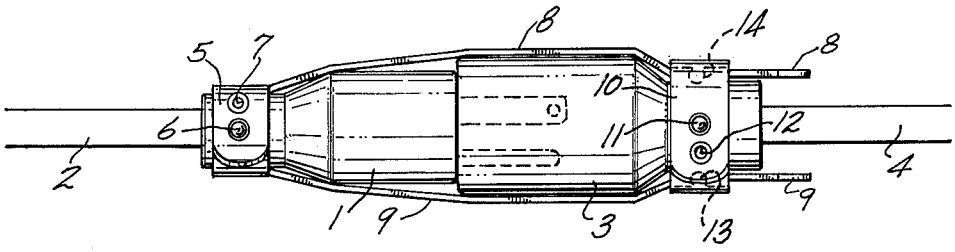
FIG. 2 is a plan view of FIG. 1.
Figure 3:
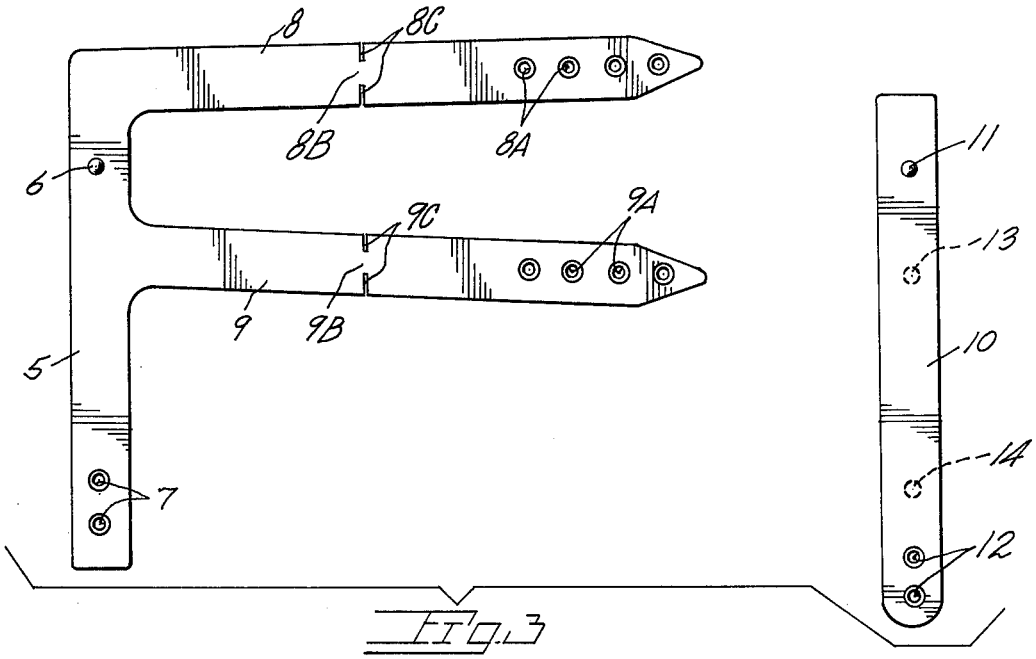
FIG. 3 is a plan view of the harness components disassociated from the plug and socket.

With continuing attention to the accompanying drawing wherein applied reference numerals indicate parts similarly identified in the following description, the reference numeral 1 indicates a plug member having an associated power cord 2. Indicated at 3 is a socket member served by a power cord 4. The following described harness is intended for use on conventional plug and socket combinations for communicating a power source such as an electrical outlet with a remote, electrically powered tool or appliance. A practical use of the present harness would entail application of the harness to the socket of an industrial type electrical extension cord and the plug associated with the electrical cord of a power tool.

A primary member of the present harness is indicated at 5 and is of strap configuration having an upwardly projecting stud 6 thereon for cooperation with either of two strap apertures indicated at 7. Integral with the primary member are a pair of elongate connectors embodied in flexible members 8 and 9 which, when strap 5 is applied about a plug member, lie along opposite sides of the plug and socket. Each elongate connector member defines a series of apertures as at 8A and 9A in its outer end segment with the edge being somewhat raised to provide reinforced openings. For purposes of lessening the chance of snagging on various types of obstructions, the outer ends of the elongate members are somewhat pointed which additionally prevents inadvertent unsnapping of an elongate member upon contact with an obstruction.

A secondary member 10 is in the form of a strap having a stud 11 formed thereon for engagement with either of a pair of strap apertures at 12. For the purpose of adjustable engagement with elongate members 8 and 9 I provide a pair of studs 13 and 14 which are located on opposite sides of the socket member when strap 10 is located therearound. The present harness, as aforesaid, is highly adaptable to various plug and socket combinations wherein both the length and cross sectional dimensions will vary widely. While the harness has been described as being in a specific relationship to a plug and socket in some instances, the primary and secondary members may be located opposite from their shown and described position.

In some instances it may be desirable to provide a release capability in the harness whereupon a worker may release the harness and separate the plug and socket as, for example, when a defective power tool results in the tool grounding through the user. In such instances, a tensioning force exerted on the tool power cord will result in the tensioning of elongate members 8 and 9. A non-continuous segment of each elongate member is indicated at 8B and 9B provided by the inward extending slots 8C and 9C the extent of which will determine what force is required to sever the members 8 and 9.

The present harness may be produced by low cost manufacturing methods wherein the harness is constructed from a suitable synthetic plastic such as a vinyl plastic. An alternative harness may be provided with conventional snaps in place of the stud and aperture arrangement shown.

While I have shown but one embodiment of the invention it will be apparent to those skilled in the art that the invention may be embodied still otherwise without departing from the spirit and scope of the invention claimed.

Having thus described the invention what is desired to be secured under a Letters Patent is:

1. A harness for attachment to and retention of various sized electrical plug and socket combinations in coupled engagement, said harness comprising, a primary member of flexible construction including a ring forming member for placement adjacent one end of a plug and socket combination, elongate flexible members integral at one of their ends with said ring forming primary member and extending outwardly therefrom in a substantially perpendicular manner, said members flexible throughout their length to follow plug and socket contours, said elongate members having segments of reduced crossection whereby a predetermined tensile load applied to said elongate members will cause same to sever at said segments allowing plug and socket separation by manual pulling on the plug or socket in emergency situations, a secondary member also of flexible construction and adapted for placement adjacent the other end of the plug and socket combination, and interengageable means carried by end segments of the elongate members and by said secondary member enabling coupling of the primary and secondary members at selected distances from one another whereby coupled plugs and sockets of various sizes and shapes may be retained against accidental separation.

2. The harness claimed in claim 1 wherein said primary and secondary members each include a stud and multiple apertured portions to enable securement of said members about plug and socket combinations of different crossectional dimensions.

* * * * *